United States Patent [19]

Takahashi et al.

[11] Patent Number: 4,784,210

[45] Date of Patent: Nov. 15, 1988

[54] METHOD AND INSTALLATION FOR REPLACEMENT OF MOLD IN BLOCK TYPE MOVING MOLD CONTINUOUS CASTING MACHINE

[75] Inventors: Shuzo Takahashi, Yokohama; Yutaka Tsuchida, Yokosuka; Shiro Osada; Nobuhisa Hasebe, both of Yokohama, all of Japan

[73] Assignees: Ishikawajima-Harima Jukogyo Kabushiki Kaisha; Nippon Kokan Kabushiki Kaisha, both of Japan

[21] Appl. No.: 141,636

[22] Filed: Jan. 7, 1988

[30] Foreign Application Priority Data

Jan. 30, 1987 [JP] Japan ..... 62-20143

[51] Int. Cl.[4] ..... B22D 11/06

[52] U.S. Cl. ..... 164/479; 164/430

[58] Field of Search ..... 164/430, 431, 479, 481

[56] References Cited

U.S. PATENT DOCUMENTS 3,835,917 9/1974 Gyongyos ..... 164/430

*Primary Examiner*—Kuang Y. Lin

[57] ABSTRACT

In a block type moving mold continuous casting machine of the type wherein a pair of block molds group each consisting of a plurality of block molds interconnected with each other in the form of an endless track are disposed in opposed relationship to define a mold cavity therebetween; and molten metal is supplied from one open end of the mold cavity and a solidified casting is continuously withdrawn out of the other open end of said mold cavity, a method and installation capable of removing a block mold which has been thermally deformed during the casting process from a carrier in a simple manner and quickly replacing with a new or repaired block mold.

9 Claims, 3 Drawing Sheets

METHOD AND INSTALLATION FOR REPLACEMENT OF MOLD IN BLOCK TYPE MOVING MOLD CONTINUOUS CASTING MACHINE

BACKGROUND OF THE INVENTION

The present invention relates to a method and installation for replacement of a mold in a block type moving mold continuous casting machine.

In general, a block type moving mold continuous casting machine comprises a plurality of block molds a assembled in the form of an endless track into a mold assembly b as shown in FIG. 5. A pair of such mold assemblies b are disposed in vertically opposed relationship to define a mold cavity c having opposite open ends. A nozzle d is inserted at one of the open ends to supply the cavity c with molten metal from a tundish e while the molds a and a solidified casting f are transported to the other open end, whereby molten metal is continuously cast. Such continuous casting machines are generally classified into horizontal moving mold type continuous casting machines and inclined moving mold type continuous casting machines.

Each of the block molds a is securely joined to a corresponding carrier with bolts.

Although being cooled, the block molds a may be distorted due to temperature differences when they contact molten metal at high temperatures. The block molds a temporally and slightly distorted will recover to their original shape when the temperatures of the mold blocks drop.

However, repeated or large distortions due to such temperature differences will not be remedied even when the temperatures of the block molds a drop, resulting in permanent distortions.

Surfaces of the permanently distorted block molds a do not remain flat, so that a degree of surface accuracy of the casting f is degraded.

Meanwhile, attachment and solidification of molten metal on the surfaces of the block molds a will cause irregularities on the surfaces, so that similarily a degree of surface accuracy of the casting f is degraded.

The block mold a with irregular surfaces due to distortions or attachment of metal is conventionally removed by loosening the bolts and replaced with substitutive block mold which is to be securely joined to the carrier with bolts. Such replacement of the block mold a is very cumbersome.

A primary object of the present invention is therefore to solve the above and other problems encountered in the prior art, accomplishing the replacement of any distorted block mold in a simple and easy manner.

To the above and other ends, the present invention provides a method for replacement of a mold in a block type moving mold continuous casting machine comprising the steps of releasing clamping forces of clamps exerting on opposite sides of a block mold for secure mounting thereof on a corresponding carrier of an endless track, retracting at least the clamps on one of said opposite sides, shifting said block mold in a direction of said retracted clamps to thereby remove said block mold, and installing and securely clamping substitutive block mold in position.

The present invention furthermore provides an installation for replacement of a mold in a block type moving mold continuous casting machine wherein block molds are joined to a plurality of carriers, comprising pivoted clamps at opposite sides of each of said carriers for securely clamping a corresponding block mold; springs loaded below said carrier for biasing said clamps in a direction of said clamps securely clamping the block molds; a passage groove on an undersurface of the block mold for allowing said block mold to pass without interference with said clamps in their released positions; clamp release means disposed in position on opposite sides of said endless track; and pushing means adjacent to said clamp release means and on one side of said endless track for pushing the block mold.

When the clamping forces of the clamps on the opposite sides of the carrier are released by the clamp release means on the opposite sides, at least the clamps on one of the sides are slightly and slantingly swang as shown in FIG. 2 or are vertically swang through a relatively great angle as shown in FIG. 3 to thereby align their upper ends with the passage grooves; or the pivot shafts of the clamps are threaded to allow the clamps to shift laterally as shown in FIG. 4 when the clamping forces are released. Therefore, the block mold is easily removed by pushing the mold block in a transverse direction by the pushing means.

After a substitutive block mold is installed and the clamp release means is de-energized, the clamps securely clamp the newly installed block mold under the forces of the bias springs.

The above and other effects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
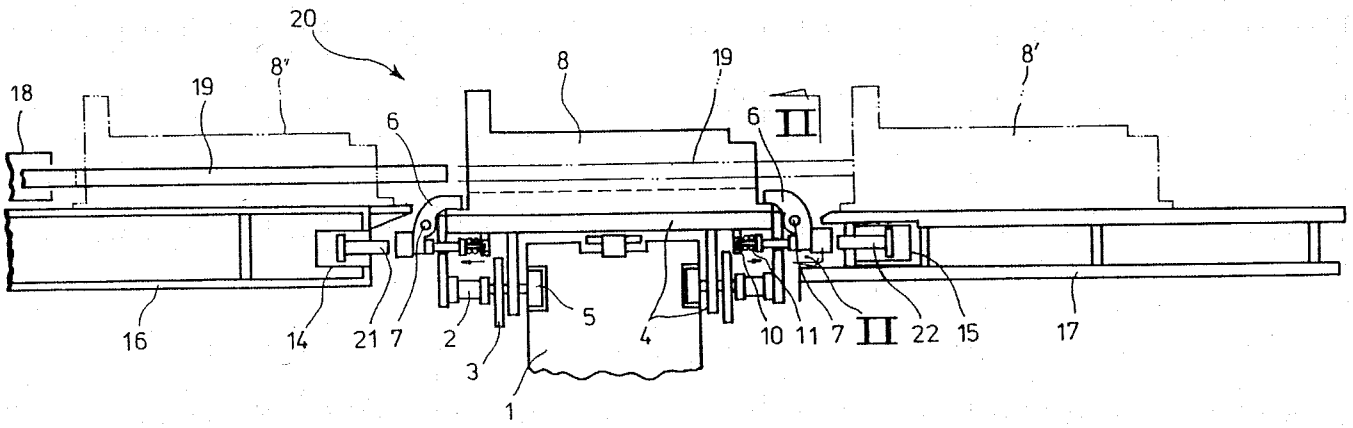
FIG. 1 is a view used to explain a first embodiment of a block mold replacing installation in accordance with the present invention.
Figure 2:
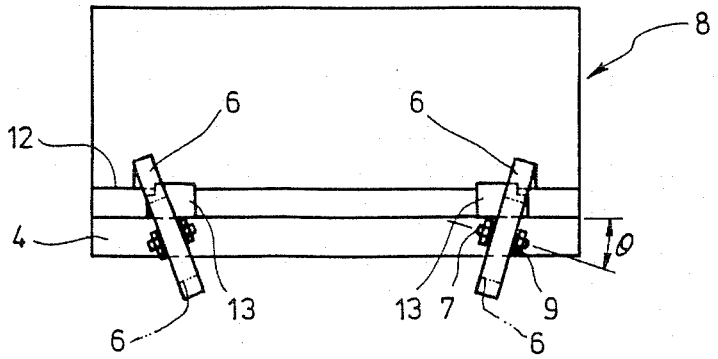
FIG. 2 is a sectional view taken along the line II—II in FIG. 1.

FIGS. 1 and 2 show an embodiment of an installation for replacing a block mold in accordance with the present invention. Reference numeral 1 represents a guide mounted on an endless track stand; 2, chains interconnected continuously around the endless track stand; 3 and 4, carriers interconnected with each other in the form of an endless track; and 5, rollers. A suitable number of clamps 6 are mounted through brackets 9 on opposite sides of the carriers such that a shaft 7 for pivotally supporting each clamp 6 is installed at a predetermined angle of inclination to a supporting surface of each carrier for supporting the block mold 8. Bias springs 11 are loaded on brackets 10 mounted on the undersurfaces of the carriers 3 and 4 adjacent to the outside sides thereof so that each clamp 6 is forced in the direction in which a tip of each clamp 6 is forcibly pressed against a step 12 on the block mold 8.

Passage grooves 13 are formed on the undersurface of the block mold 8 in the direction perpendicular to the direction of the circulation movement of the block mold 8 such that the passage groove 13 is adapted to be aligned with an upper end of any clamp 6 at retracted position at which at least one clamp released from the clamping force is retracted.

Clamp release cylinders 14 and 15 are mounted on frames 16 and 17 on opposite sides of the carriers 3 and 4 interconnected in the form of an endless track so that the lower end of each clamp 6 is adapted to be pushed against the eleastic force of the bias spring 11. A block-mold pushing cylinder 18 is mounted on the frame 16 so that the block mold 8 is adapted to be displaced by a piston rod 19 extended from the block-mold pushing cylinder 18 in the transverse direction onto the other frame 17. A block-mold replacement station 20 is constructed in the manner described above.

In the continuous casting machine constructed as described above, each block mold 8 is securely clamped by a plurality of (four in this embodiment) clamps 6 under the elastic forces of the springs 11 and is circulated along the endless track.

In the case of the replacement of an old block mold 8 with a new one, first the circulation movement of the block molds 8 is interrupted. At the block-mold replacement station 20, the piston rods 21 and 22 of clamp release cylinders 14 and 15 are located to be aligned with the clamps 6 and then the piston rods 21 and 22 of the cylinders 14 and 15 are extended. As a result, each clamp 6 is forced to pivot about its shaft 7 and the lower end of the clamp 6 is pushed toward the bracket 10 against the elastic force of the bias spring 11, whereby the clamp 6 is released from the clamping force.

The upper end of the released clamp 6 easily becomes out of phase with the clamping position because its shaft 7 is inclined as described above, and becomes in phase with the passage groove 13 at the undersurface of the block mold 8 so that they do not interfere with each other.

Then the piston rod 19 of the block-mold pushing cylinder 18 is extended so that the block mold 8 which is released from the clamping force and therefore is free is displaced transversely onto the frame 17 because the clamp 6 is passed through by the groove 13 of the block mold 8. After the piston rod 19 of the pushing cylinder 18 has been withdrawn, a new or repaired block mold 8'' is lifted and mounted on the frame 16 which is emptied and is forced move onto the carrier 4 by the pushing cylinder 18. When the piston rods 21 and 22 of the clamp release cylinders 14 and 15 are withrawn, each clamp 6 is forced to be pressed upon the step 12 of the block mold 8'' under the elastic force of restitution of the bias spring 11. Thus the block mold 8'' is securely mounted on the carrier 4.

The block mold 8' on the frame 17 is transported by a crane or the like to a repair station.

Figure 3:
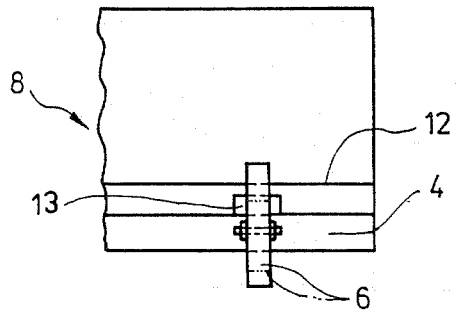
FIG. 3 is a view used to explain another embodiment of a clamping device in accordance with the present invention.

Referring next to FIG. 3, another embodiment of a clamping device will be described. The pivotal supporting shaft of each clamp 6 is disposed in parallel with the carrier 4 so that the clamp 6 may be pivoted in a vertical plane. A relatively greater angle of pivotal movement of the clamp 6 causes the the clamp 6 to be aligned with the groove 13 through which the block mold 8 is shifted without interference with the clamp 6 at its released position.

Figure 4:
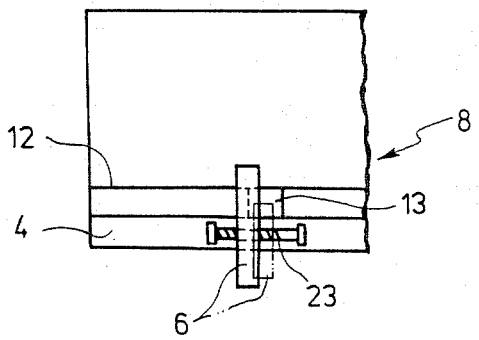
FIG. 4 is a view used to explain a further embodiment of a clamping device in accordance with the present invention.
Figure 5:
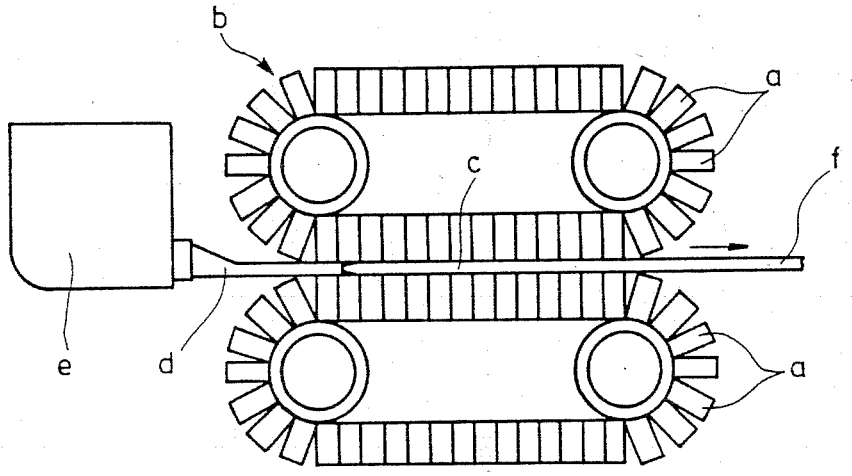
Fig.5 PRIOR ART
FIG. 5 is a view used to explain a conventional block type moving mold continuous casting machine.

Next referring to FIG. 4, a further embodiment of the clamping device will be described in which the supporting shaft of the clamp 6 is threaded so that when the clamping force is released, the clamp 6 is caused to shift axially of the supporting shaft and to align with the passage groove 13.

It is to be understood that the present invention is not limited to the above-described embodiments and that various modifications and variations may be effected without leaving the true spirit of the present invention. For instance, instead of the hydraulic cylinders, screw rods or drawing car may be used as clamp releasing means and block-mold pushing means.

As described above, according to the method and installation for replacement of a mold in a block type moving mold continuous casting machine, the following and other excellent results can be attained.

(I) Since the block mold is securely mounted on the carrier by means of clamps and as compared with the conventional way for securely mounting a block mold on the carrier by means of bolts, the step for replacing an old block mold by a new or repaired block mold becomes simple and threfore can be accomplished within a short period of time. As a result, the operation efficiency can be increased.

(II) When the clamps for securely mounting the block mold on the carrier are brought to their respective retracted positions, the block mold can be easily pushed and shifted without interference with the clamps.

What is claimed is:

1. A method for replacement of a mold in a block type moving mold continuous casting machine comprising the steps of releasing clamping forces of clamps exerting on opposite sides of a block mold for secure mounting thereof on a corresponding carrier of an endless track, retracting at least the clamps on one of said opposite sides, shifting said block mold in a direction of said retracted clamps to thereby remove said block mold, and installing and securely clamping substitutive block mold in position.

2. A method according to claim 1 wherein said block molds each interconnected in the form of an endless track are disposed in vertically opposed relationship, thereby defining a mold cavity.

3. A method according to claim 1 wherein the clamping force is an elastic force.

4. A method according to claim 1 wherein the clamping force is released by a hydraulic cylinder, a screw rod or a drawing car.

5. A method according to claim 1 wherein the clamp released from the clamping force is passes through by a groove formed on an underface of the block mold.

6. An installation for replacement of a mold in a block type moving mold ontinuous casting machine wherein block molds are joined to a plurality of carriers, comprising pivoted clamps at opposite sides of each of said carriers for securely clamping a corresponding block mold; springs loaded below said carrier for biasing said clamps in a direction of said clamps securely clamping the block molds; a passage groove on an undersurface of the block mold for allowing said block mold to pass without interference with said clamps in their released positions; clamp release means disposed in positions on opposite sides of said endless track; and pushing means adjacent to said clamp release means and on one side of said endless track for pushing the block mold.

7. An installation according to claim 6 wherein each clamp is inclined relative to a block-mold supporting surface of each carrier.

8. An installation according to claim 6 wherein a pivotal supporting shaft of each clamp is disposed in parallel with each carrier and such that each clamp can rotate through a sufficient angle of rotation.

9. An installation according to claim 6 wherein a pivotal supporting shaft of each clamp is threaded so that when the clamping force is released, each clamp is displaced laterally.

* * * * *